United States Patent [19]

Henriksson

[11] Patent Number: 4,676,323

[45] Date of Patent: Jun. 30, 1987

[54] HYDRAULICALLY OPERATED PERCUSSIVE MACHINE AND AN ACCUMULATOR THEREFOR

[75] Inventor: Stig R. Henriksson, Nacka, Sweden

[73] Assignee: Atlas Copco Aktiebolag, Nacka, Sweden

[21] Appl. No.: 734,869

[22] Filed: May 16, 1985

[30] Foreign Application Priority Data

May 24, 1984 [SE] Sweden ..... 8402802

[51] Int. Cl.[4] ..... B25D 17/00

[52] U.S. Cl. ..... 173/116; 173/134; 138/30

[58] Field of Search ..... 60/418, 371, 413; 138/30, 31; 91/265, 300, 290; 92/134; 173/116, 134

[56] References Cited

U.S. PATENT DOCUMENTS

| | | | |
|---|---|---|---|
| 3,251,380 | 5/1966 | Mercier | 138/30 |
| 3,580,290 | 5/1971 | Sugimura | 138/30 |
| 4,165,788 | 8/1979 | Montabert | 173/134 |
| 4,386,627 | 6/1983 | Lachaux | 138/30 |

FOREIGN PATENT DOCUMENTS 2065775 7/1981 United Kingdom .

*Primary Examiner*—Donald R. Schran
*Assistant Examiner*—James L. Wolfe
*Attorney, Agent, or Firm*—Frishauf, Holtz, Goodman & Woodward

[57] ABSTRACT

A hydraulic percussive machine, for example a jack hammer or a rock drill, has an accumulator with a flexible diaphram (35). A lift valve (40, 41, 42) closes the outlet of the accumulator if the flow exceeds the normal flow substantially and it traps a volume of oil between the diaphragm and the valve when it closes.

9 Claims, 2 Drawing Figures

HYDRAULICALLY OPERATED PERCUSSIVE MACHINE AND AN ACCUMULATOR THEREFOR

This invention relates to a hydraulically operated percussive machine comprising a cylinder, a piston hammer periodically reciprocable in the cylinder and arranged to impact upon an anvil, and an accumulator coupled to the high pressure side of the hydraulic fluid and comprising a diagram, that separates an accumulator chamber for the hydraulic fluid from a pressure gas chamber, and a valve arranged in the common inlet and outlet of the accumulator chamber, said valve being biassed open. It also relates to an accumulator per se that can be used for such an percussive machine.

In U.S. Pat. No. 2932322 an accumulator with a diaphragm or merely a bladder has a hydraulically balanced lift valve that is biassed against its open position by means of a coil spring. The valve is gradually closed by the bladder and it is fully closed just when the accumulator becomes empty. Accumulators of this kind are usually not used for hydraulic percussive machines, for example jack hammers and rock drills, because they have proved to have a shorter life than simpler accumulators that have no valve, that is, accumulators principally of the kind disclosed in EP-A-0047438 which have a diaphragm that is not reinforced and a combined inlet and outlet in the form of a support plate with a large numer of small holes.

The life of the diaphragms of such simple accumulators without valves is comparatively low when they are used for hydraulic percussive machines because the diaphragm tends to extrude through the holes in the support. In U.S. Pat. No. 3948288, a diaphragm is shown which is designed to have an improved durability. It is reinforced and it has annular support ridges which are to take support between the holes in the support plate.

It is an object of the invention to provide for an accumulator that is long lasting when used with a hydraulic percussive machine.

The invention will be described with reference to the drawings.

Figure 1:
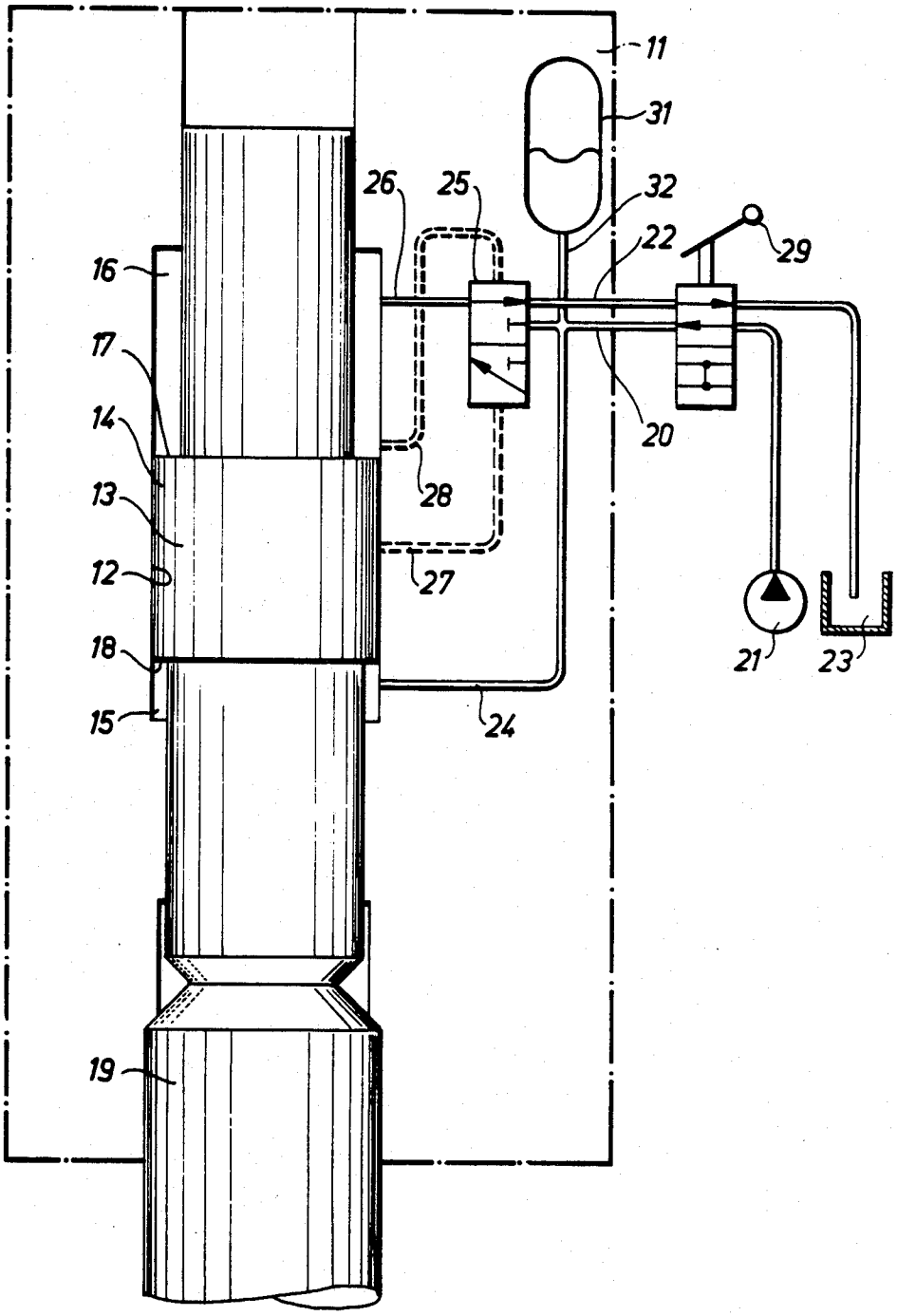
FIG. 1 is a diagram of a percussive machine according to the invention.

The percussive machine shown in the figures is a jack hammer or a rock drill. It has a housing generally referred to as 11 in FIG. 1. The housing forms a cylinder 12 for a piston hammer 13 which has a piston head 14. Two cylinder chambers 15, 16 are formed between the piston hammer 13 and the cylinder 12, and the piston head 14 has a piston area 17 in the rear cylinder chamber 16 that is larger than its piston area 18 in the front cylinder chamber 15. The piston hammer is arranged to impact on an anvil in the form of a chisel 19 which extends out of the housing 11. The impact frequency can for example be 50 Hz. The housing 11 has a high pressure inlet passage 20 coupled to a pump 21 and an outlet or return passage 22 coupled to a tank 23. The system operates with a hydraulic fluid, e.g. hydraulic oil. A manually operated supply valve 29 is arranged in the supply line from the pump 21.

The front cylinder chamber 15 is coupled directly to the inlet 20 through a passage 24 and the rear cylinder chamber 16 is coupled to a valve 25 through a passage 26. The valve 25 is coupled to the inlet and outlet passages 20, 22 and it is switched over between its two positions of pressurizing and draining the rear cylinder chamber 16 by means of two control passages 27, 28 so that the valve 25 will cause repetitive reciprocation of the piston 13. An accumulator 31 is coupled to the inlet passage 20 through a passage 32.

Figure 2:
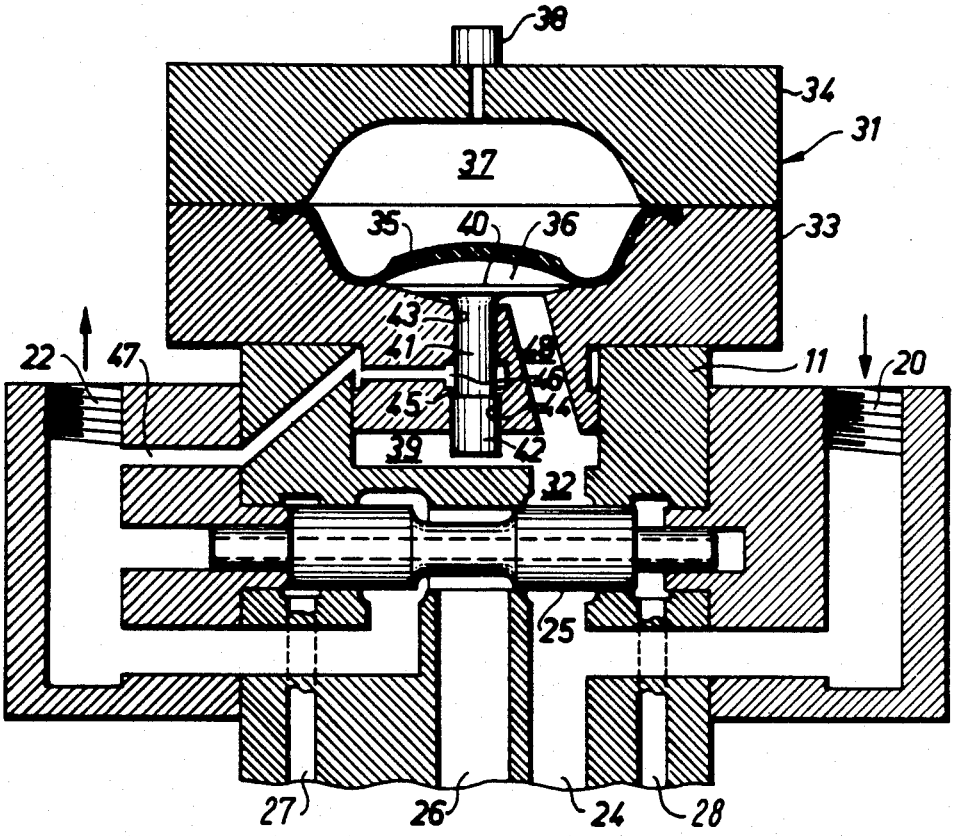
FIG. 2 is a schematic longitudinal section through the rear end of the percussive machine of FIG. 1.

In FIG. 2, parts described above with reference to FIG. 1 have been given the same reference numbers.

The accumulator 31 comprises a two-part housing 33, 34 the part 33 being screwed into the housing 11. A moulded rubber diaphragm (membrane) 35 is tightly clamped between the two housing parts 33, 34 and it separates an accumulator chamber 36 from a chamber 37 that can be filled with gas at a selected pressure, usually nitrogen, through a valve 38.

A chamber 39 is formed between the housing 11 and the part 33 of the accumulator housing. A lift valve has a head 40 and a stem 41, and the stem 41 slides in a bore 43. A plunger 42 has a larger diameter than the stem 41 and it slides in a bore 44. In operation, there will always be pressure in the chamber 39 so that the stem 41 and the plunger 42 will abut against each other. Thus, the plunger 42 can be considered to be a part of the stem 41. An annular surface 45 is thus formed on the plunger 42 as the differential surface between the plunger 42 and the stem 41. This annular surface 45 is located in a cylinder chamber 46 that is connected to the drain 22 through a passage 47.

The head 40 of the valve 40, 41, 42 is arranged to seat against the housing part 33 as seen in FIG. 2 so that it shuts off the accumulator chamber 36 from a passage 48 that forms part of the passage 32 and leads from the chamber 39 and ends under the head 40.

The valve 40, 41, 42 is biassed open since all its surfaces but the annular surface 45 are subject to the same high pressure. Thus, the force by which it is biassed open is defined by the area of the surface 45 and the pressure difference between the pressures in chamber 39 and chamber 46. The pressure in the cylinder chamber 46 acting on the surface 45 is low since the passage 47 is directly connected to the return passage 22. The pressure in the chamber 46 is thus substantially reduced as compared to the pressure in the chamber 39 and in the accumulator chamber 36. Usually, the chamber 46 is substantially relieved of pressure if the hose leading from the percussive machine to the tank is not too narrow.

In operation, the pump 21 supplies a constant flow of hydraulic fluid whereas the percussive machine requires a flow that fluctuates within each cycle of piston hammer reciprocation. The largest flow occurs just prior to impact. The accumulator takes up the fluctuations and stores energy during the return stroke and delivers it back at the end of the work stroke. When oil flows out of the accumulator chamber 36 there will be dynamic forces tending to close the valve 40, 41, 42. The static force that biasses the valve 40, 41, 42 open must be greater than these dynamic forces so that the valve remains open all the time.

When the supply valve 29 is being closed, the flow out of the accumulator chamber 36 will be much larger than normally at least during the end of the work stroke of the piston hammer 13. The flow can for example be about twice as large and the dynamic forces that tend to close the valve will increase more than that and make the valve 40, 41, 42 close. Thus, the diaphragm 35 can never hit the valve head 40 but there will be trapped oil between the valve head 40 and the diaphragm. The fact that the diaphragm 35 will usually stop in an intermediate position increases its life. Due to leakage, the diaphragm may then move to a resting position against the valve head 40 without any harmful effect since it will not impact against the valve head 40.

The pump pressure can be varied to select the energy of the impacts. Since there are only hydraulic forces acting on the valve 40, 41, 42 the operation of the valve will be substantially unchanged when the pump pressure is varied within reasonable limits. The valve will be constantly open during operation but it will close when the flow out of the accumulator chamber reaches a certain level above the normal when the percussive machine is shut off.

I claim:

1. A hydraulically operated percussive machine comprising:

a cylinder;

pump means coupled to said cylinder and having means for supplying pressurized hydraulic fluid thereto;

piston hammer means arranged to reciprocate by a drive stroke and a return stroke in said cylinder for impacting upon an anvil means, and including a drive chamber and a return chamber;

an accumulator coupled with the cylinder including therein a diaphragm separating an accumulator chamber from an accumulator pressure gas chamber, said accumulator chamber having an inlet/outlet passage, a high pressure side of the hydraulic fluid being in communication with said inlet/outlet passage, said return chamber, and a first valve means;

said first valve means subjected to differential pressure communicating said high pressure side of the hydraulic fluid and said inlet/outlet passage with the drive chamber during said drive stroke, and communicating said drive chamber with a low pressure side of the hydraulic fluid during said return stroke;

second valve means between said accumulator chamber and said inlet/outlet passage for maintaining communication therebetween in its open position and for at least substantially blocking communication therebetween in its closed position; and piston means coupled with said second valve means and subjected to differential pressure between, on the one hand, said inlet/outlet passage and, on the other hand, said low pressure side of the hydraulic fluid, said differential pressure being directed to keep said second valve means in its open position during both the drive stroke and the return stroke when the percussive machine is operated in a normal reciprocating mode under supply of high pressure fluid to said inlet/outlet from said pump means, and for automatically allowing said second valve means to move to its closed position in advance of said diaphragm due to decrease of said differential pressure and increased outward flow from said accumulator chamber when supply of high pressure hydraulic fluid from the pumping means is terminated.

2. A percussive machine according to claim 1, wherein the second valve means is a lift valve that has a head (40) and a stem (41, 42), said piston means having a first piston surface that provides an end face for the stem (41, 42) in a pressure chamber being subjected to pressure of the fluid in the inlet/outlet passage of the accumulator chamber.

3. A percussive machine according to claim 2, wherein the stem comprises an inner slimmer part (41) and an outer wider separate part (42) the two parts (41, 42) abutting against each other to form said annular surface (45) between themselves.

4. A percussive machine according to claim 2, wherein the piston has a second piston means surface in a relief chamber, and passage means connecting said relief chamber to said low pressure side of the hydraulic fluid.

5. A percussive machine according to claim 1, wherein the second valve means is a lift valve having a head and a stem, and the piston means is a plunger abutting said stem and subjected to said differential pressure.

6. A hydraulic accumulator comprising:

an accumulator chamber;

a pressure gas chamber;

a diaphragm separating the accumulator chamber from said pressure gas chamber;

an inlet/outlet passage for fluid flow to and from said accumulator chamber adapted to receive fluid under substantialy constant high pressure flow from a pump and subjected to a fluctuating fluid pressure and flow demand from a hydraulic system of machinery periodically demanding supply of said fluid under pressure;

valve means between the accumulator chamber and the inlet/outlet passage having an open position for maintaining communication therebetween and having a closed position for substantially blocking communication therebetween, and piston means connected to move in unison with said valve means and subjected to differential pressure between said inlet/outlet passage and low fluid pressure in said hydraulic system, said differential pressure being directed for maintaining said valve means in its open position during said pressure fluctuations when said high fluid pressure is supplied to said inlet/outlet passage and to said system, and for automatically allowing said valve means to move to its closed position in advance of said diaphragm due to decrease of said differential pressure and increased flow from said accumulator chamber when supply of said high fluid pressure to said inlet/outlet passage and to said system ceases.

7. An accumulator according to claim 6, wherein the valve is a lift valve that has a head (40) and a stem (41, 42), said piston means having a first piston surface that provides an end face for the stem (41, 42) in a pressure chamber subjected to pressure of the fluid in the inlet/outlet passage of the accumulator chamber.

8. A percussive machine according to claim 7, wherein the piston has a second piston means surface in a relief chamber, and passage means connecting said relief chamber to said low pressure side of the hydraulic fluid.

9. An accumulator according to claim 6, wherein the valve is a lift valve having a stem and the piston means is a plunger abutting said stem and subjected to said differential pressure.

* * * * *